US007147438B2

(12) United States Patent
DePaoli

(10) Patent No.: US 7,147,438 B2
(45) Date of Patent: Dec. 12, 2006

(54) ELECTRIC TURBINE

(76) Inventor: Michael DePaoli, 8275 E. Bell Rd., #3188, Scottsdale, AZ (US) 85260

( * ) Notice: Subject to any disclaimer, the term of this patent is extended or adjusted under 35 U.S.C. 154(b) by 225 days.

(21) Appl. No.: 10/852,034

(22) Filed: May 24, 2004

(65) Prior Publication Data

US 2005/0280664 A1 Dec. 22, 2005

(51) Int. Cl.
*F03G 7/00* (2006.01)

(52) U.S. Cl. ..... 416/3; 416/30; 416/35; 60/641.8

(58) Field of Classification Search ..... 60/641.8; 416/3, 30, 35
See application file for complete search history.

(56) References Cited

U.S. PATENT DOCUMENTS 4,953,811 A * 9/1990 Smith ..... 244/17.19
5,736,643 A * 4/1998 Bores et al. ..... 73/660
5,839,529 A * 11/1998 DePaoli ..... 180/65.1
5,957,672 A * 9/1999 Aber ..... 417/423.12
6,882,059 B1 * 4/2005 DePaoli ..... 290/44
2006/0046108 A1 * 3/2006 Milacic ..... 429/17

* cited by examiner

*Primary Examiner*—Hoang Nguyen
(74) *Attorney, Agent, or Firm*—Parsons & Goltry; Robert A. Parsons; Michael W. Goltry

(57) ABSTRACT

An electric turbine includes a fan with a plurality of blades each with a tip having a permanent magnet positioned in the tip. The fan is mounted for rotation about an axis with the blades extending radially outwardly from the axis of rotation and with the tips adjacent an outer extremity. An electromagnet and a magnetic sensor are each positioned to be magnetically aligned with the permanent magnet in the tip of each blade during one complete rotation of the fan. A controller supplies a pulse of current, in response to reception of a sensor signal from the magnetic sensor, to the electromagnet at a time when the electromagnet is magnetically aligned with the permanent magnet in one blade of the fan. A solar panel supplies power to the controller.

14 Claims, 1 Drawing Sheet

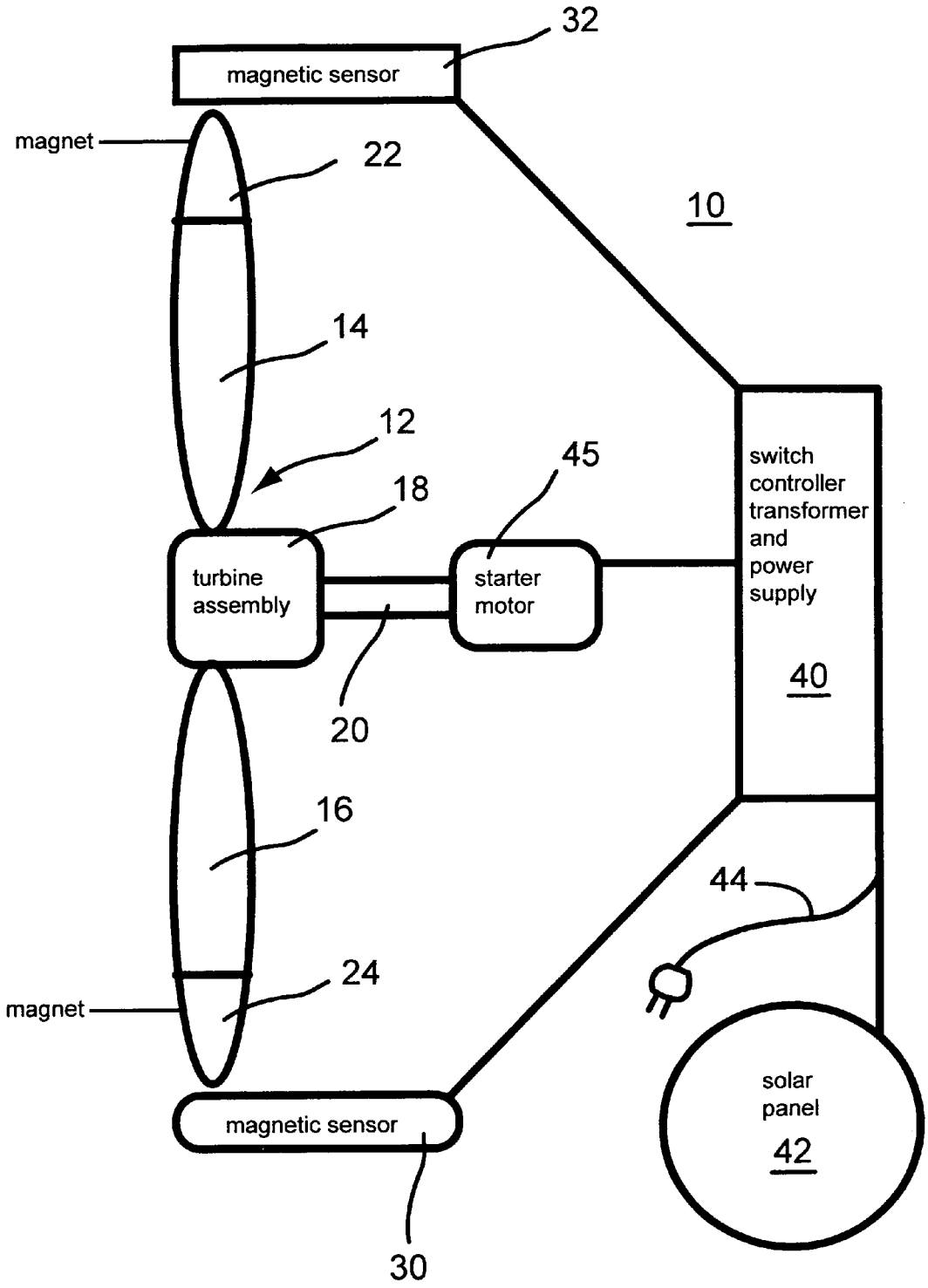
32
magnetic sensor
magnet
22
10
14
12
45
18
switch
controller
transformer
and
power
supply
turbine
assembly
starter
motor
40
20
16
44
24
magnet
solar
panel
42
magnetic sensor
30

ELECTRIC TURBINE

FIELD OF THE INVENTION

This invention relates to electric turbines.

More particularly, this invention relates to electric turbines including propellers or fans and used for air movement.

BACKGROUND OF THE INVENTION

The present invention pertains to electric turbines, one of the primary uses of which is to move air. In this context the electric turbine includes a propeller or fan which produces the air movement or other desired objective.

As a typical example, in large commercial buildings there are massive air fans that are constantly running, whenever the air conditioning is on. Also, in parking garages, long tunnels, emergency staircases, etc. fans are continually running to ensure proper air movement and to prevent a build-up of dangerous gases. Traditionally, the fans or electric turbines are driven by an electric motor attached to a central mounting shaft. However, this arrangement is relatively inefficient because it takes substantially more power to turn the shaft with its relatively short torque arm compared to the much longer torque arm of the fan blades.

Also, the type of fans described above generally turn at relatively low rates, since they are intended only to keep air moving and not necessarily to move large quantities of air fast (e.g. for cooling or the like). Thus, another problem that occurs is the electric motors run too fast and must be geared-down, which can add additional cost to the structure and to the operation.

It would be highly advantageous, therefore, to remedy the foregoing and other deficiencies inherent in the prior art.

Accordingly, it is an object of the present invention to provide a new and improved electric turbine.

It is another object of the present invention to provide a new and improved electric turbine with improved driving force.

It is another object of the present invention to provide a new and improved electric turbine that is more efficient to operate.

It is another object of the present invention to provide a new and improved electric turbine that is easily controlled and relatively inexpensive to manufacture.

SUMMARY OF THE INVENTION

The above problems and others are at least partially solved and the above objects and others realized in a new and improved electric turbine that includes a fan with a plurality of blades each with a tip having a permanent magnet positioned in the tip. The fan is mounted for rotation about an axis with the blades extending radially outwardly from the axis of rotation and with the tips adjacent an outer extremity. An electro-magnet and a magnetic sensor are each positioned to be magnetically aligned with the permanent magnet in the tip of each blade during one complete rotation of the fan. A controller supplies a pulse of current, in response to reception of a sensor signal from the magnetic sensor, to the electro-magnet at a time when the electro-magnet is magnetically aligned with the permanent magnet in one blade of the fan.

In a preferred embodiment, a solar panel is connected to supply power to the controller. The power supply for the controller can also, or alternatively, include a battery. An optional starter motor can also be included for initial rotation of the fan during starting operations, in specific embodiments.

BRIEF DESCRIPTION OF THE DRAWING

The foregoing and further and more specific objects and advantages of the invention will become readily apparent to those skilled in the art from the following detailed description taken in conjunction with the drawings in which the single FIGURE illustrates an embodiment of an electric turbine in accordance with the present invention.

DETAILED DESCRIPTION OF THE DRAWING

Turning to the drawing, an embodiment of an electric turbine 10 in accordance with the present invention is illustrated. Turbine 10 includes a propeller or fan 12 having a plurality of blades. For purposes of this explanation fan 12 has two blades 14 and 16, which are situated 180 degrees apart or in opposed relationship. A mounting assembly 18 mounts blades 14 and 16 rotatably on a shaft 20. Generally, mounting assembly 18 and/or shaft 20 are fixedly mounted or positioned within turbine 10 by some convenient mounting structure (not shown).

Outer or tip portions 22 and 24 of blades 14 and 16, respectively, include permanent magnets. An electromagnet 30 is positioned adjacent fan 12 so as to be magnetically coupled to the tips of fan 12 in at least one orientation as fan 12 rotates on shaft 20. It will be understood that electromagnet 30 generally includes one or more windings around a core of magnetic material (e.g. iron, nickel, etc.). Also, a magnetic sensor 32 is positioned to sense the presence or proximity of one of the tips 22 or 24. Generally, a magnetic sensor includes a coil (with or without a core) so that passage of a permanent magnet tip, 22 or 24, in proximity thereto induces an electric current, e.g. sensor signal. In this embodiment electro-magnet 30 and magnetic sensor 32 are illustrated as separate components situated 180 degrees apart for ease of understanding but it will be understood that more than one of either or both components could be included and in some embodiments both an electro-magnet and a sensor can be included in a single component.

It will be understood that electro-magnet 30 and magnetic sensor 32 can be mounted, for example, in a mounting frame or other opening in which fan 12 is mounted for rotation. Further, electromagnet 30 and magnetic sensor 32 are electrically connected to a controller and power supply 40. In a preferred embodiment, a solar panel 42 provides power to controller and power supply 40, which generally will also have an alternate power supply, such as batteries and/or a power inlet 44 designed to be attached to a convenient external source of power. It will be understood that solar panel 42, power inlet 44, and batteries can be used alone or in any desired combination for specific applications. In addition to the above structure, a starter motor 45 may optionally be mechanically attached to shaft 20 and electrically attached to controller and power supply 40.

In operation, fan 12 is rotated on shaft 20 through at least one cycle by any convenient means, such as starter motor 45. In some applications, fan 12 may be constructed to run continuously and the actual starting cycle only occurs, for example, after shut-down for repairs or the like. Thus, starter motor 45 would not, generally, be included. When starter motor 45 is included it is, or can be, a very small motor which is either mechanically coupled to shaft 20 for a short time or only electrically pulsed initially by controller and power supply 40. As fan 12 rotates, tip 22 comes into proximity (or magnetic alignment) with magnetic sensor 32 and a sensor signal is relayed to controller and power supply 40. In this description, the term "magnetic alignment" refers to a position in which the permanent magnet of the tip and the magnetic sensor (or the electro-magnet) magnetically interact in the designed way.

In this two-blade embodiment, simultaneous with the magnetic alignment of tip 22 and magnetic sensor 32, tip 24 comes into proximity (or magnetic alignment) with electro-magnet 30. The sensor signal supplied to controller and power supply 40 triggers the controller to supply an electric signal, generally a pulse of current, to energize electro-magnet 30. The pulse of current supplied to electro-magnet 30 is timed by the controller to energize electro-magnet 30 so as to magnetically attract tip 24 and/or magnetically repel tip 24. The magnetic attraction and/or repulsion of tip 24 produces another half-cycle of rotation in fan 12.

As fan 12 completes the next half-cycle, magnetic sensor 32 senses the proximity or magnetic alignment of tip 24 and sends a sensor signal to controller and power supply 40 which again sends a pulse of current to electromagnet 30. Thus, tip 22 is magnetically attracted and/or magnetically repelled, which produces another half-cycle of rotation. This rotation continues as long as power is available to supply pulses of current to electromagnet 30. It will be understood by those skilled in the art that while tips 22 and 24 are described as including permanent magnets, any ferrous or other magnetic material can be considered permanent magnets for purposes of this invention. Thus, the tips of the turbine can be formed of any ferrous or magnetic material.

Here several features should be specifically noted: First, the pulses of current supplied to electro-magnet 30 can be relatively small since one of the main elements that determines the amount of magnetism produced is the number of windings in the electro-magnet; Second, the speed of fan 12 can easily be controlled by the controller with simple adjustments to the size, length and timing of the current pulse; Third, since all of the torque driving fan 12 is applied to the outer tip (i.e. tips 22 and 24), the drive is very efficient because the torque arm includes the entire length of either blade 14 or blade 16.

It will be understood that two blades are illustrated for better understanding of the operation but any number of blades (at least two or greater) could be used. Also, while a single electromagnet is illustrated and explained for convenience, any number of electromagnets can be with any number of blades. For example, electromagnets could be situated at 90 degree intervals, using the two-blade fan illustrated, and the controller could pulse the electro-magnets at the proper times, i.e. when the electromagnets are magnetically aligned with the permanent magnets in the tips of the blades. The position of the blades would still be determined by one or more magnetic sensors. By providing sun sensor 42 for power and possibly a battery for storage, the only limitation on the running time of turbine 10 would be the wear of components.

The invention has been described above with reference to one or more preferred embodiments. However, those skilled in the art will recognize that changes and modifications may be made in the described embodiments without departing from the nature and scope of the invention. For instance, the shape of blades 14 and 16 might be modified and the positioning of electromagnet 30 and magnetic sensor 32 might be modified for more efficient operation.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. An electric turbine comprising:

a fan with a plurality of blades each with a tip, each blade having a permanent magnet positioned in the tip, and the fan being mounted for rotation about an axis with the blades extending radially outwardly from the axis of rotation and with the tips adjacent an outer extremity;

an electromagnet positioned to be magnetically aligned with the permanent magnet in the tip of each blade during one complete rotation of the fan, the electro-magnet including an electric current input;

a magnetic sensor positioned to be magnetically aligned with the permanent magnet in the tip of each blade during one complete rotation of the fan, the magnetic sensor including sensor signal generating structure; and a controller electrically connected to the sensor signal generating structure of the magnetic sensor and to the electric current input of the electro-magnet, the controller including circuitry supplying a pulse of current, in response to reception of a sensor signal from the magnetic sensor, to the electric current input of the electro-magnet at a time when the electro-magnet is magnetically aligned with the permanent magnet adjacent the tip of one blade of the plurality of blades of the fan.

2. An electric turbine as claimed in claim 1 including a plurality of electro-magnets each positioned to be magnetically aligned with the permanent magnet in the tip of each blade during one complete rotation of the fan, each electro-magnet of the plurality of electro-magnets including an electric current input.

3. An electric turbine as claimed in claim 1 wherein the electro-magnet and the magnetic sensor are included in a single component.

4. An electric turbine as claimed in claim 3 wherein the controller includes an electrical power supply.

5. An electric turbine as claimed in claim 4 wherein the power supply includes a solar panel.

6. An electric turbine as claimed in claim 4 wherein the power supply includes a battery.

7. An electric turbine as claimed in claim 1 further including a starter motor mechanically coupled to the fan for rotation of the fan about the axis during starting operations.

8. An electric turbine as claimed in claim 7 wherein the starter motor is electrically coupled to the controller for receiving a short pulse of current during starting operations.

9. An electric turbine comprising:

a fan with a plurality of blades each with a tip, each blade having a permanent magnet positioned in the tip, and the fan being mounted for rotation about an axis with the blades extending radially outwardly from the axis of rotation and with the tips adjacent an outer extremity;

an electro-magnet positioned to be magnetically aligned with the permanent magnet in the tip of each blade during one complete rotation of the fan, the electro-magnet including an electric current input;

a magnetic sensor positioned to be magnetically aligned with the permanent magnet in the tip of each blade during one complete rotation of the fan, the magnetic sensor including sensor signal generating structure;

a controller electrically connected to the sensor signal generating structure of the magnetic sensor and to the electric current input of the electro-magnet, the controller including circuitry supplying a pulse of current, in response to reception of a sensor signal from the magnetic sensor, to the electric current input of the electro-magnet at a time when the electro-magnet is magnetically aligned with the permanent magnet adjacent the tip of one blade of the plurality of blades of the fan; and a power supply electrically coupled to the controller for supplying power to generate the pulses of current.

10. An electric turbine as claimed in claim 9 wherein the power supply includes one of a battery and a solar panel.

11. An electric turbine comprising:

a fan with a plurality of blades each with a tip, each blade having a permanent magnet positioned in the tip, and the fan being mounted for rotation about an axis with the blades extending radially outwardly from the axis of rotation and with the tips adjacent an outer extremity;

an electro-magnet positioned to be magnetically aligned with the permanent magnet in the tip of each blade during one complete rotation of the fan, the electro-magnet including an electric current input;

a magnetic sensor positioned to be magnetically aligned with the permanent magnet in the tip of each blade during one complete rotation of the fan, the magnetic sensor including sensor signal generating structure;

a controller electrically connected to the sensor signal generating structure of the magnetic sensor and to the electric current input of the electro-magnet, the controller including circuitry supplying a pulse of current, in response to reception of a sensor signal from the magnetic sensor, to the electric current input of the electro-magnet at a time when the electro-magnet is magnetically aligned with the permanent magnet adjacent the tip of one blade of the plurality of blades of the fan;

a power supply including a solar sensor electrically coupled to the controller for supplying power to generate the pulses of current; and a starter motor mechanically coupled to the fan for rotation of the fan about the axis during starting operations, the starter motor being electrically coupled to the controller for receiving a short pulse of current during starting operations.

12. An electric turbine as claimed in claim 11 including a plurality of electro-magnets each positioned to be magnetically aligned with the permanent magnet in the tip of each blade during one complete rotation of the fan, each electro-magnet of the plurality of electro-magnets including an electric current input.

13. An electric turbine as claimed in claim 11 wherein the electro-magnet and the magnetic sensor are included in a single component.

14. An electric turbine as claimed in claim 11 wherein the power supply further includes a battery.

* * * * *